United States Patent [19]

Adolf De Rop et al.

[11] 3,999,508

[45] Dec. 28, 1976

[54] APPARATUS FOR ELECTROSTATICALLY COATING BULB INTERIORS

[75] Inventors: Walter Jan Roza Adolf De Rop; Jozef Jan Baptist Boeckx, both of Eindhoven, Netherlands

[73] Assignee: U.S. Philips Corporation, New York, N.Y.

[22] Filed: Mar. 11, 1975

[21] Appl. No.: 557,328

Related U.S. Application Data

[63] Continuation of Ser. No. 357,893, May 7, 1973, abandoned.

[30] Foreign Application Priority Data

June 21, 1972 Netherlands ..... 7208454

[52] U.S. Cl. ..... 118/47; 118/622; 118/308

[51] Int. Cl.[2] ..... B05C 19/00; B05B 5/02

[58] Field of Search ..... 118/308, 312, 302, 622, 118/47; 51/12; 239/106, 15, 112, 113; 302/34, 51, 57; 222/193

[56] References Cited

UNITED STATES PATENTS

| | | | |
|---|---|---|---|
| 709,448 | 9/1902 | Shaver | 51/12 |
| 847,269 | 3/1907 | Wise | 51/12 |
| 1,319,193 | 10/1919 | Von Porat | 51/12 X |
| 1,668,080 | 5/1928 | Mack | 239/112 X |
| 2,553,625 | 5/1951 | Andersen | 51/12 |
| 2,811,131 | 10/1957 | Lopenski et al. | 118/622 X |
| 2,988,458 | 6/1961 | Meister et al. | 118/622 X |
| 3,182,425 | 5/1965 | Goss et al. | 51/12 X |
| 3,335,024 | 8/1967 | Lopenski et al. | 118/622 X |
| 3,715,838 | 2/1973 | Young et al. | 51/12 |

*Primary Examiner*—John P. McIntosh
*Attorney, Agent, or Firm*—Frank R. Trifari; Robert S. Smith

[57] ABSTRACT

The invention relates to a method for the electrostatic covering with a powder layer of successive envelope for lamps. The powder each time to be provided is mixed with a transport gas and supplied to a first envelope to be covered via a duct. In order to terminate the covering operation, the supply of the powder to the transport gas is interrupted while the flow of the transport gas is maintained for cleaning the duct by blowing.

6 Claims, 4 Drawing Figures

APPARATUS FOR ELECTROSTATICALLY COATING BULB INTERIORS

Figures 1, 2:
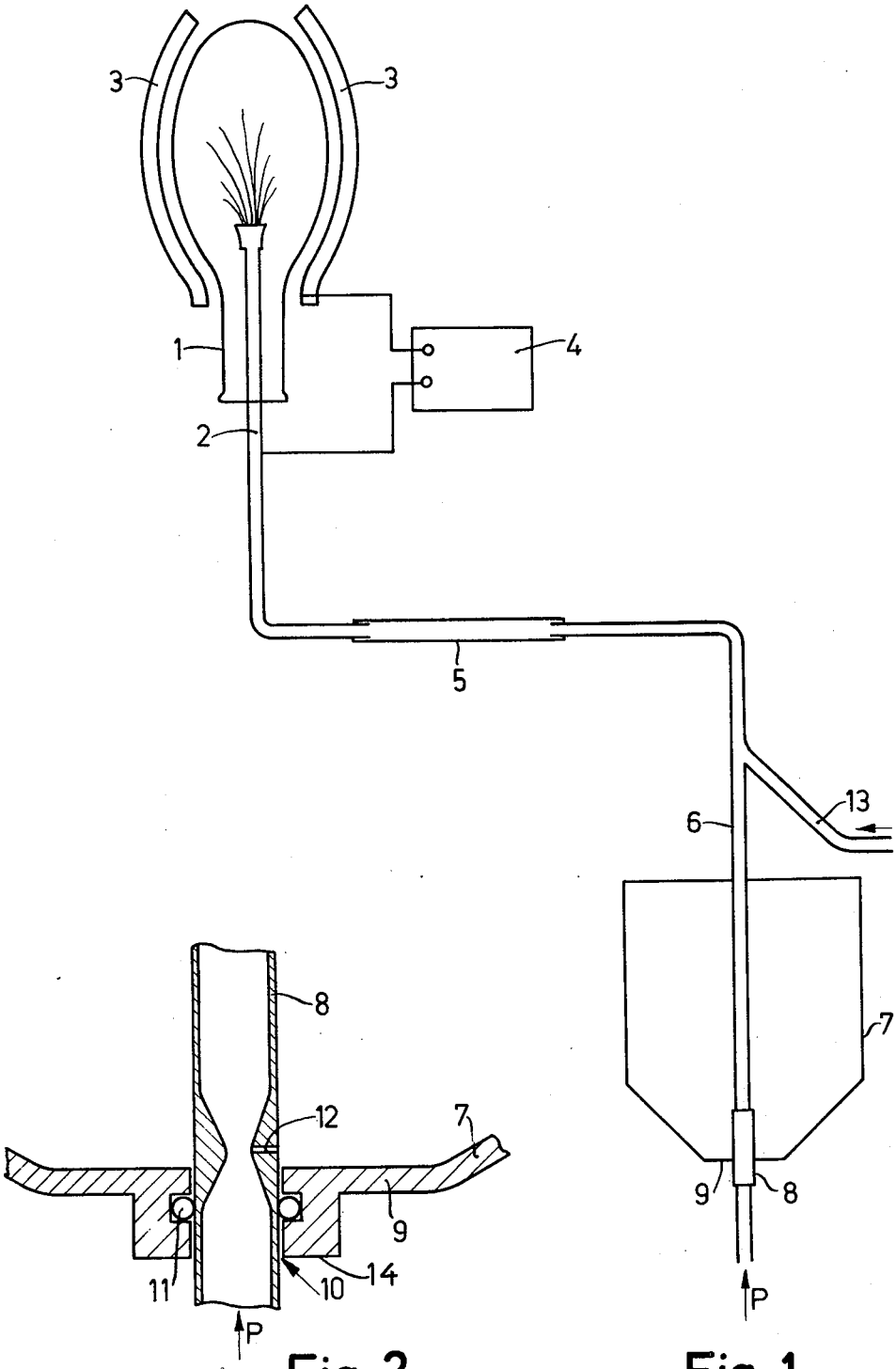

This is a continuation, of application Ser. No. 357,893, filed May 7, 1973, abandoned.

It is known to cover the inner surface of a number of envelopes for incandescent lamps or discharge lamps with a powder which is supplied to the envelope to be treated by means of a transport gas via a duct. The end of the duct opening inside the envelope is constructed as a first electrode, while a second electrode which shows a potential difference relative to the first electrode is arranged on the outside of the envelope. The powder particles flowing from the duct adhere to the inner wall of the envelope under electrostatic action. In the known method, this process which is known as "electrostatic covering" is terminated by interrupting the flow of the transport gas. However, when said flow of the transport gas is interrupted without further measures, the powder particles present in the duct will adhere to the wall of the duct. The danger exists that the powder deposit formed after covering a few envelopes suddenly works loose from the wall of the duct and lands in an envelope. In the successive treatment of a number of envelopes this has for its result that not all the envelopes are provided with an equally thick layer of powder and that some envelopes show a layer of a non-uniform thickness.

In order to avoid this drawback it has already been proposed, see U.S. Pat. No. 2,884,895, to clean the duct after the covering operation by suction. For that purpose, the duct is connected by means of a T-piece via a suction tube with an injector serving as a suction pump. An adjustable valve is incorporated in the suction tube. Said valve is closed during the covering operation and is opened by means of an electro-mechanical control mechanism as soon as the flow of the transport gas is terminated. The powder particles remained in the duct are then sucked off by the injector effect. The drawback of this method is that it necessarily results in a comparatively expensive device which is sensitive to disturbances.

It is an object of the invention to provide a method for the electrostatic covering with which the problem of the powder deposit in the duct is solved in an equally simple and efficacious manner.

For that purpose, the method for the electrostatic covering with a powder of the inner surface of successive envelopes for lamps in which each time the powder to be provided is mixed with a transport gas and the mixture thus formed is transported via a duct to a first envelope to be covered, after which, before a subsequent envelope is covered, the duct is blown clean to remove powder particles present in the duct, is characterized according to the invention in that the supply of the powder to the transport gas is each time interrupted to remove the powder particles, while the flow of the transport gas is maintained. The powder particles which are present in the duct at the instant at which the supply of the powder to the transport gas is interrupted, are conveyed to the envelope to be covered without interruption by the non-interrupted flow of the transport gas. The quantity of powder supplied to an envelope depends upon the time during which the supply of the powder to the transport gas takes place. In choosing said supply time it should be taken into account that in the method according to the invention all the powder supplied to the transport gas during a covering operation lands in the treated envelope.

The invention furthermore relates to a lamp which has an envelope which is provided with a powder layer according to the above described method.

The invention furthermore relates to a device for the electrostatic covering with a powder of the inner surface of successive envelopes for lamps, said device comprising a powder container as well as an injector, at least one supply aperture being present for the supply of the powder to the transport gas flowing through the injector, said injector furthermore communicating with the duct leading to the envelope to be covered. Such a device is known inter alia from the U.S. Pat. No. 2,884,895 and, as already stated, it suffers from the drawback of being comparatively expensive and sensitive to disturbances. It is therefore an object of the invention to provide a simple device which for that purpose is characterized in that an interruptor cooperating with the injector is present and is movable relative to the supply aperture in such manner that in the position of the interruptor assumed during the cleaning operation by blowing, the supply aperture communicates with a gas-filled space. For cleaning the duct by blowing it is not strictly necessary for the supply aperture in the injector to communicate with a gas-filled space. When, however, the supply aperture itself should also be cleaned, which will be the case in particular when an extra pipe communicates with the supply aperture, the supply aperture during cleaning the duct by blowing must communicate with a gas-filled space so that powder particles which are present in the duct and the supply aperture are drawn into the duct by the injector action. Both the transport gas and the gas drawn in through the supply aperture may be ambient air.

A favourable embodiment of the device according to the invention is characterized in that the injector and the container are movable relative to each other, the interruptor being formed by a part of the wall of the container. The container is preferably arranged in a fixed position and the injector is movable, for example, slidable, in its axial direction or rotatable about its longitudinal axis. This movability should be such that the supply aperture passes the relevant part of the wall of the container when the injector is moved from its one extreme position to its other extreme position.

Another favourable embodiment of the device according to the invention is characterized in that the injector is arranged inside the container, the interruptor being formed as a pipe surrounding at least a part of the injector with some play and being slidable relative to it in the axial direction, one end of said pipe being closed by a bottom in which an aperture is recessed through which the injector projects, the other end of said pipe being open and emptying outside the container in the ambient air. For example, the pipe is arranged vertically in the container, the open end being present above the powder level.

A further embodiment of the device according to the invention is characterized in that the supply aperture comprises a nozzle which widens in the container in the form of a funnel, the interruptor being formed as a pipe which is slidable in the axial direction and extends coaxially with the supply aperture, one end of said pipe opening into the ambient air outside the container and the other end cooperating with the funnel-like nozzle. The funnel-like nozzle may be present above the level of the powder in the container, the powder should then be thrown up by means of a stirrer so that a cloud of powder is formed which is drawn into the nozzle.

A further favourable embodiment is characterized in that the duct communicates with a gas supply tube to influence the composition of the mixture and the quantity of transport gas. This influencing of the composition of the powder-gas mixture and the quantity of transport gas is important when it is desirable that more than one type of envelopes can be treated by means of said device. For example, according as the envelope to be provided with a layer of powder is larger, the powder content in the powder-gas mixture will generally have to be higher with the same covering time in connection with the required thickness of the powder layer. The presence of the gas supply tube also presents the possibility of influencing the outflow rate of the gas, which is also of importance when the duct is blown clean. For example, according as the powder forms a more sticky substance, the gas flow during cleaning the duct and during the covering operation should be more powerful.

Figure 3:
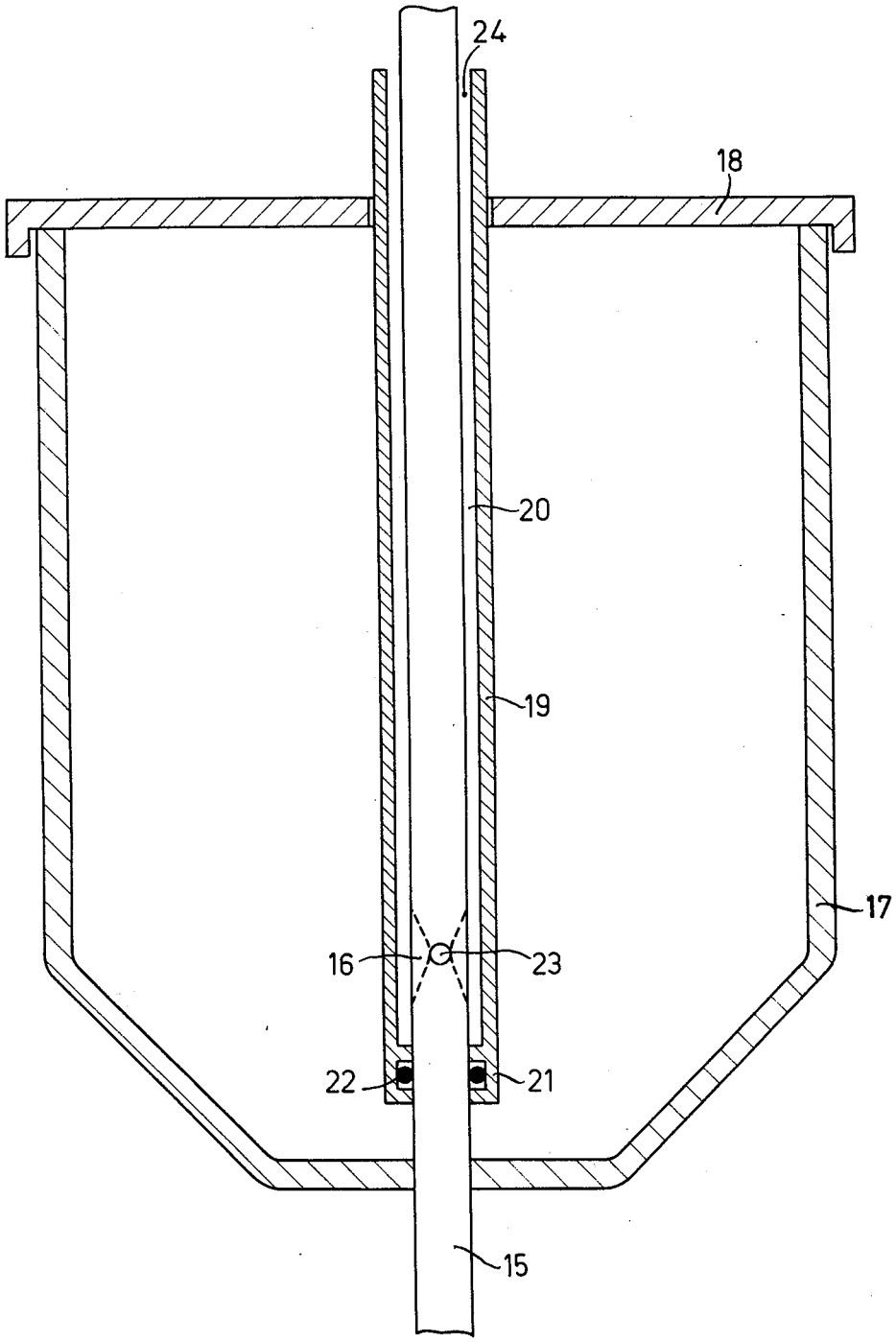
Figure 4:
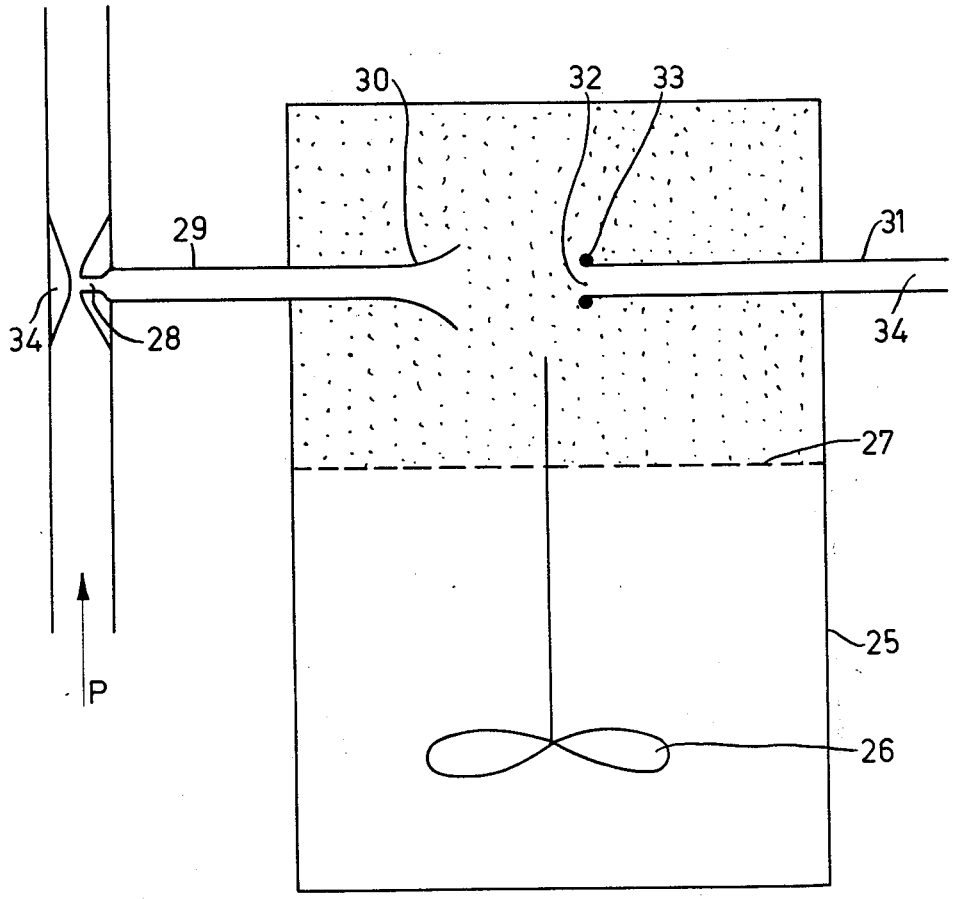

The invention will be described in greater detail with reference to a drawing, in which FIG. 1 shows a principle diagram of the device according to the invention, FIG. 2 shows a detail of the device according to FIG. 1 on a larger scale, FIG. 3 shows a detail of another embodiment of the device according to the invention, and FIG. 4 shows another embodiment of the device according to the invention.

The envelope to be treated is denoted by 1 in FIG. 1. A duct 2 via which the powder is conveyed to the envelope 1 opens into said envelope 1. Gas burners 3 are arranged on the outside of the envelope. The envelope is arranged so as to be rotatable about its longitudinal axis. The gas burners are connected to one terminal of a high voltage source 4 and the duct 2 is connected to the other terminal. Via a flexible intermediate member 5 the duct 2 is connected to a duct 6 which extends in the powder-filled container 7. The duct 6 is connected to an injector 8 which, as shown in FIG. 2, extends through an aperture 10 present in the bottom 9 of the container 7. The aperture 10 furthermore comprises a sealing ring or collar 11. The flow of the transport gas, in this example compressed air, is denoted by the arrow P. The injector comprises a supply aperture 12 which serves for the supply of the powder to the transport gas. The duct 6 furthermore communicates with a gas supply tube 13. Due to the presence of the flexible intermediate member 5 it is possible to move the duct 6 and the tube 13 with the injector 8 upwards and downwards in such manner that in the highest position of the injector 8 the supply aperture 12 is present inside the powder container and in the lowest position of the injector it is below the edge 14 of the bottom 9.

The method according to the invention is carried out as follows: the envelope is heated by means of the burners 3. Via the gas flames and the burners the glass of the envelope is connected to one terminal of the high voltage source. The high voltage is then applied so that a potential difference is formed between the outflow aperture of the duct 2 and the envelope. When the envelope has reached the desired temperature, the compressed air is blown through the ducts 6 and 2 in the highest position of the injector. Due to the injector action, the powder is drawn in from the container and taken along to the envelope by the airflow. The powder particles are charged electrostatically in the duct. Said charge is transferred to the glass wall. During the covering operation a uniform layer of powder is formed on the wall of the envelope. In order to terminate the covering operation, the injector with the connected ducts and tube 13 are moved downwards until the supply aperture 12 is present outside the container. The flow of compressed air is maintained so that the powder particles still present in the ducts are blown into the envelope. Because the supply aperture communicates with the ambient air, it is blown clean by the negative pressure in the injector. In this manner the whole system of powder supply is blown "powder-free". The flow of compressed air is then cut-off and the high voltage can be switched off after which the envelope is removed and a new envelope placed between the burners. The tube 13 through which compressed air with an adjustable pressure also flows also comprises a supply control which is not shown in the drawing. The desired composition of the powder-air mixture and the total quantity of the mixture can be influenced with the adjustable pressure of the compressed air in the injector and in the gas supply tube 13, and with the position of the supply control.

In the embodiment shown in FIGS. 1 and 2 the injector is movable in the direction of its longitudinal axis. It is of course also possible to arrange the injector in a part of the wall of the container in such manner that the longitudinal axis of the injector lies in the plane of the relevant part of the wall. By rotating the injector about its longitudinal axis it can be achieved that the supply aperture empties inside the container in one position and empties in the ambient air in the other position.

FIG. 3 shows still another construction with which the supply of the powder to the transport gas can be interrupted. The duct 15 in which the injector 16 is incorporated is arranged immovably relative to the powder container 17. The container is closed by a cover 18. The duct 15 is surrounded by a pipe 19 over part of its length. A gap which is denoted by 20 is present between the pipe 19 and the duct. The pipe 19 is closed at its lower end by a bottom 21 through which the duct 15 passes. A sealing ring 22 is furthermore provided between the bottom and the duct. The supply aperture in the injector is denoted by 23. The free end 24 of the pipe 19 empties into the ambient air.

The pipe 19 is movable in the axial direction. In the position of the pipe shown in FIG. 3, the supply aperture 23 is in open communication with the ambient air via the gap 20. Thus this is the position of the pipe in which the ducts are cleaned by blowing. During the axial covering treatment, the bottom 21 is slid to above the supply aperture 23.

FIG. 4 shows still another embodiment of the device according to the invention. The injector 34 in this embodiment is arranged outside the container 25. A stirrer 26 by means of which a cloud of powder can be formed above the powder level denoted by a broken line 27 is arranged in said powder container. Communicating with the supply aperture 28 in the injector 34 is a pipe 29 which empties inside the container with its funnel-like nozzle 30. The device furthermore comprises a second pipe 31 which is movable in the direction of the supply aperture 28. The end 33 of pipe 31 comprises a sealing ring 33 which fits in the funnel-like nozzle 30. The other end 34 of the pipe 31 empties in the ambient air.

When a cloud of powder is formed by the stirrer and the pipe 31 assumes the position shown in the drawing, the powder will be drawn into the pipe 29 by the injector effect and be supplied to the compressed air via the supply aperture 28. In order to terminate the covering operation, the tube 31 is moved to the left until the scaling ring 33 engages the nozzle 30. As a result of this, air is drawn in through the duct 31 so that the powder particles still present in the duct 29 and the supply aperture 28 are drawn into the injector.

What is claimed is:

1. Apparatus for electrostatically coating the interior of an associated light bulb envelope which comprises:

a container for holding powder;

a first conduit having a first end in fluid communication with the associated bulb envelope and a second end;

means for urging a substance through said first conduit, said means for urging being connected to said second end of said first conduit and having a first port communicating with the interior of said container in one axial position of said means for urging and with the ambient atmosphere in a second axial position of said means for urging, said means for urging further including a second port for connection to a fluid source said means for urging causing in said one axial position of said means for urging powder from said first port to move into said first conduit responsive to fluid flow into said second port and causing in said second axial position air to flow from the ambient atmosphere to said first conduit;

a first electrode disposed on said one end of said first conduit;

a second electrode disposed about the outside of the associated bulb envelope;

2. The apparatus as described in claim 1 wherein said second electrode is a gas burner for heating the associated bulb envelope.

3. The apparatus as described in claim 1 wherein said means for urging comprises a venturi having an axial bore at ech end of a throat, said second port communicating with one of said axial bores and said first port communicating with said throat.

4. The apparatus as described in claim 3 wherein said means for urging includes a collar disposed in sealing engagement about a circumferential surface of said venture. said one axial position of said means for urging being when said first port is on one side of said collar and said second axial position being when said first port is on the other side of said collar.

5. The apparatus as described in claim 1, further including additional means for modulating the ratio of fluid from said second port and powder from said container in said one position of said means for urging which comprises a second conduit connected to said first conduit intermediate said first end and said means for urging.

6. The apparatus as described in claim 5, wherein the included angle intermediate said first and second conduit is an acute angle.

* * * * *

UNITED STATES PATENT AND TRADEMARK OFFICE

CERTIFICATE OF CORRECTION

PATENT NO. : 3,999,508

DATED : December 28, 1976

INVENTOR(S) : WALTER JAN ROZA ADOLF DE ROP ET AL

It is certified that error appears in the above-identified patent and that said Letters Patent are hereby corrected as shown below:

Column 6, Claim 3, line 3, "ech" should be --each--.

Claim 4, line 4, "venture" should be --venturi--.

Signed and Sealed this

Third Day of May 1977

[SEAL]

*Attest:*

RUTH C. MASON
*Attesting Officer*

C. MARSHALL DANN
*Commissioner of Patents and Trademarks*